US010449419B1

(12) United States Patent
Link, Sr.

(10) Patent No.: US 10,449,419 B1
(45) Date of Patent: Oct. 22, 2019

(54) SWIM FIN ASSEMBLY

(71) Applicant: Patrick Link, Sr., Rocklin, CA (US)

(72) Inventor: Patrick Link, Sr., Rocklin, CA (US)

( * ) Notice: Subject to any disclaimer, the term of this patent is extended or adjusted under 35 U.S.C. 154(b) by 0 days.

(21) Appl. No.: 16/009,332

(22) Filed: Jun. 15, 2018

(51) Int. Cl.
*A63B 31/12* (2006.01)

(52) U.S. Cl.
CPC ..... *A63B 31/12* (2013.01); *A63B 2208/03* (2013.01); *A63B 2225/60* (2013.01)

(58) Field of Classification Search
CPC ..... A63B 31/12; A63B 31/08; A63B 31/14
See application file for complete search history.

(56) References Cited

U.S. PATENT DOCUMENTS 1,260,931 A 3/1918 Melhus
1,488,642 A 4/1924 Kjelgaard
1,843,582 A * 2/1932 Schmitt ..... A63B 31/04 441/60
3,109,186 A 11/1963 Glenn
5,087,217 A * 2/1992 Tuan ..... A63B 31/14 441/55
5,326,296 A * 7/1994 De Jesus ..... A63B 31/11 441/60
5,338,235 A 8/1994 Lee
7,040,942 B1 * 5/2006 Houck ..... A63B 31/12 441/60
9,333,392 B2 5/2016 Nakamura
9,649,535 B2 5/2017 Nicol

* cited by examiner

*Primary Examiner* — Andrew Polay

(57) ABSTRACT

A swim fin assembly for increasing propulsion during swimming includes a sleeve that is worn around a lower leg while swimming. A plurality of fins is each hingedly coupled to the sleeve. Each of the fins is urged into a deployed position on a downstroke of the lower leg during swimming. In this way each of the fins frictionally engage water thereby increasing thrust generated on the downstroke. Each of the fins is urged into a stored position on an upstroke of the lower leg during swimming to resist frictionally engaging the water thereby reducing drag on the upstroke.

5 Claims, 5 Drawing Sheets

SWIM FIN ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to fin devices and more particularly pertains to a new fin device for increasing propulsion during swimming.

BRIEF SUMMARY OF THE INVENTION

An embodiment of the disclosure meets the needs presented above by generally comprising a sleeve that is worn around a lower leg while swimming. A plurality of fins is each hingedly coupled to the sleeve. Each of the fins is urged into a deployed position on a downstroke of the lower leg during swimming. In this way each of the fins frictionally engage water thereby increasing thrust generated on the downstroke. Each of the fins is urged into a stored position on an upstroke of the lower leg during swimming to resist frictionally engaging the water thereby reducing drag on the upstroke.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
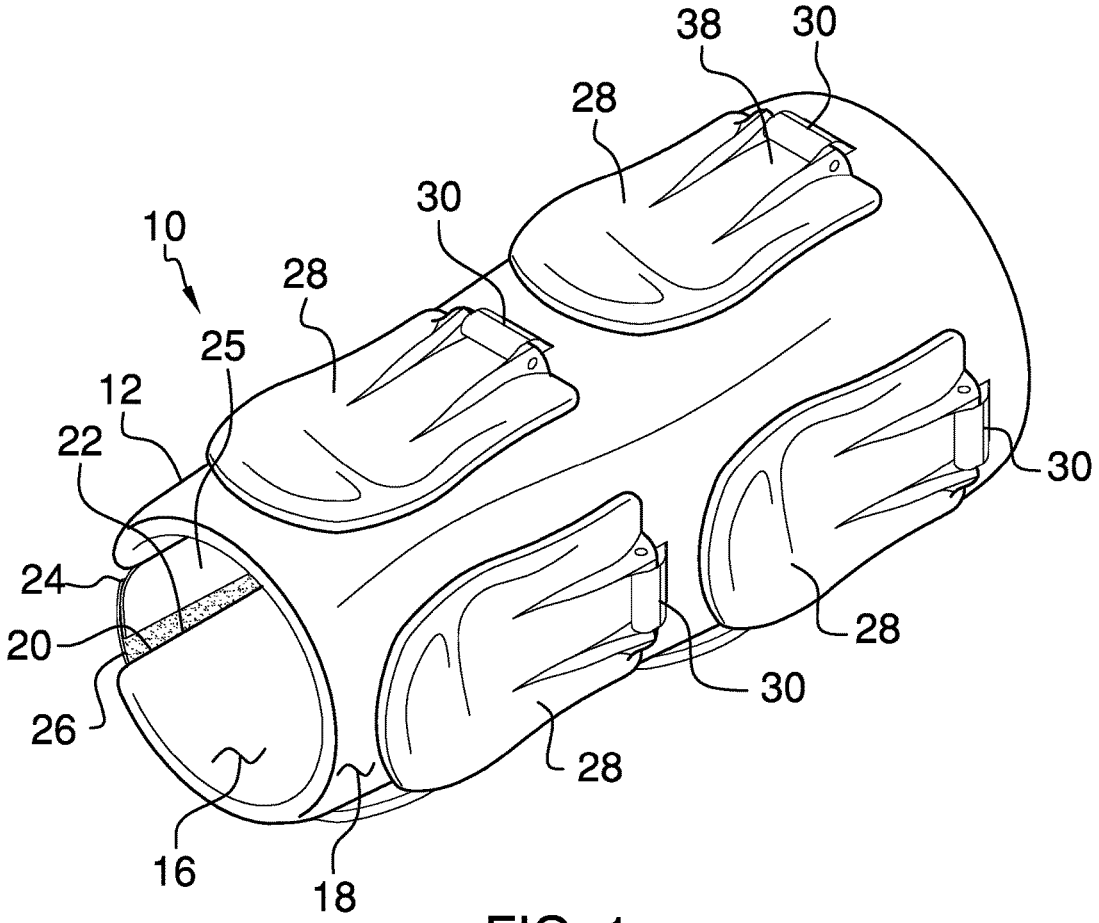
FIG. 1 is a perspective view of a swim fin assembly according to an embodiment of the disclosure.
Figure 2:
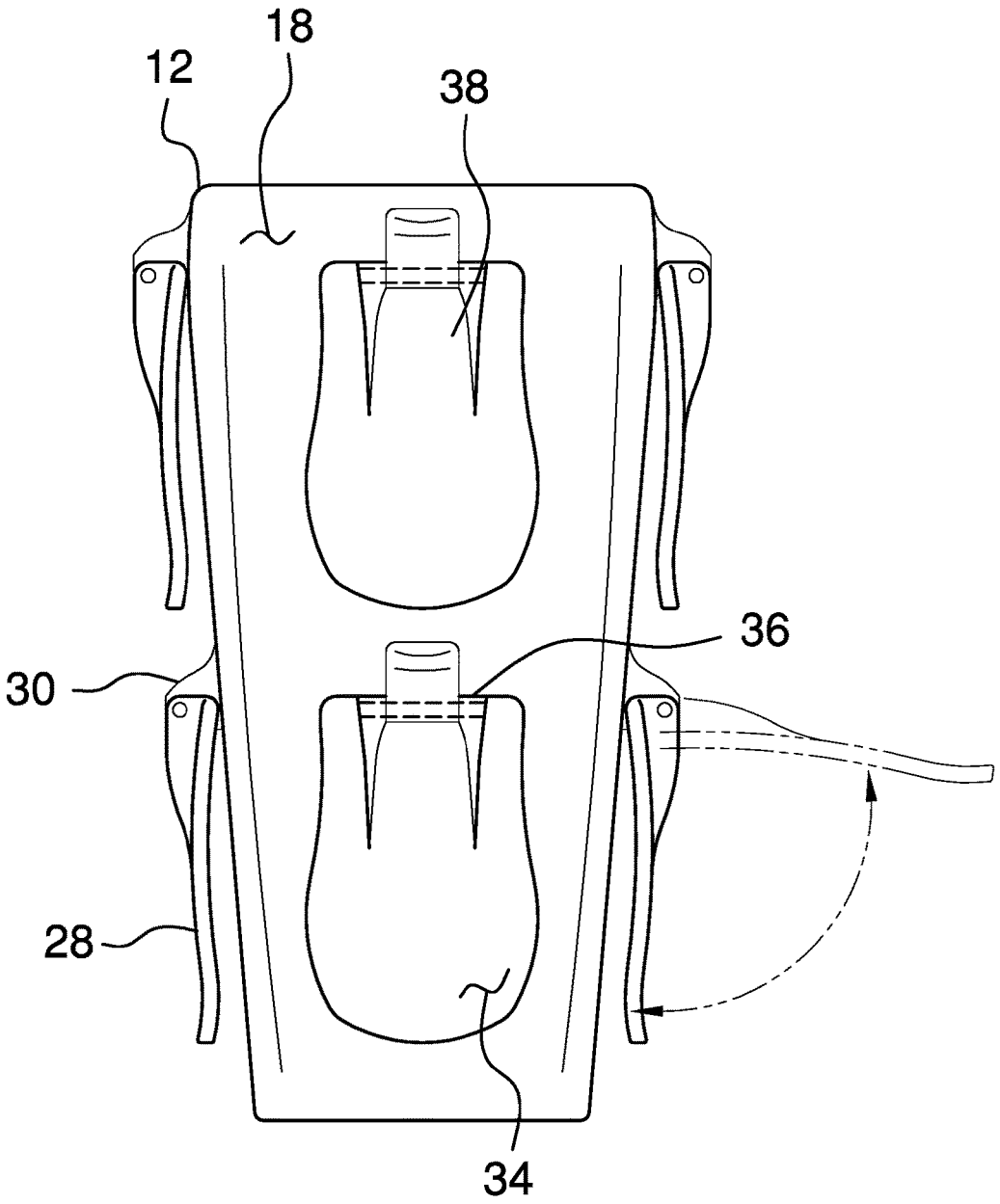
FIG. 2 is a top view of an embodiment of the disclosure.
Figure 3:
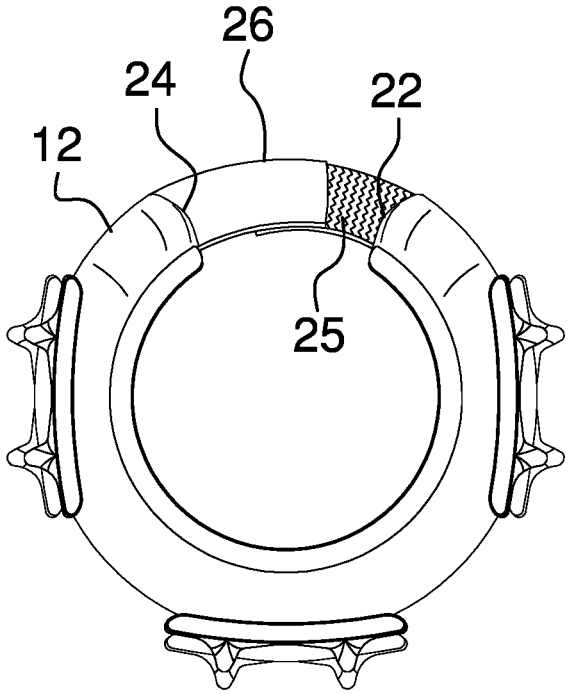
FIG. 3 is a front view of an embodiment of the disclosure.
Figure 4:
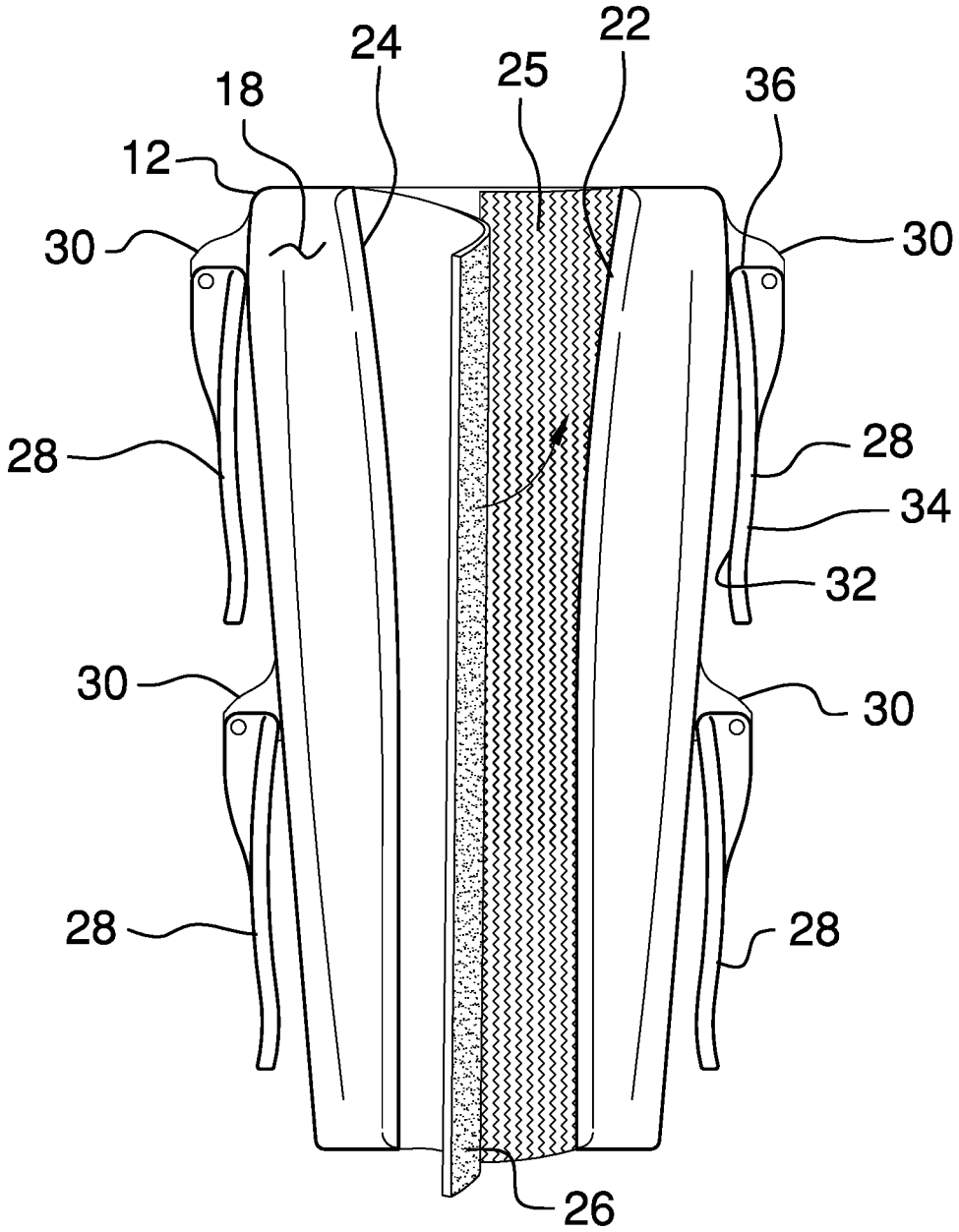
FIG. 4 is a bottom view of an embodiment of the disclosure.
Figure 5:
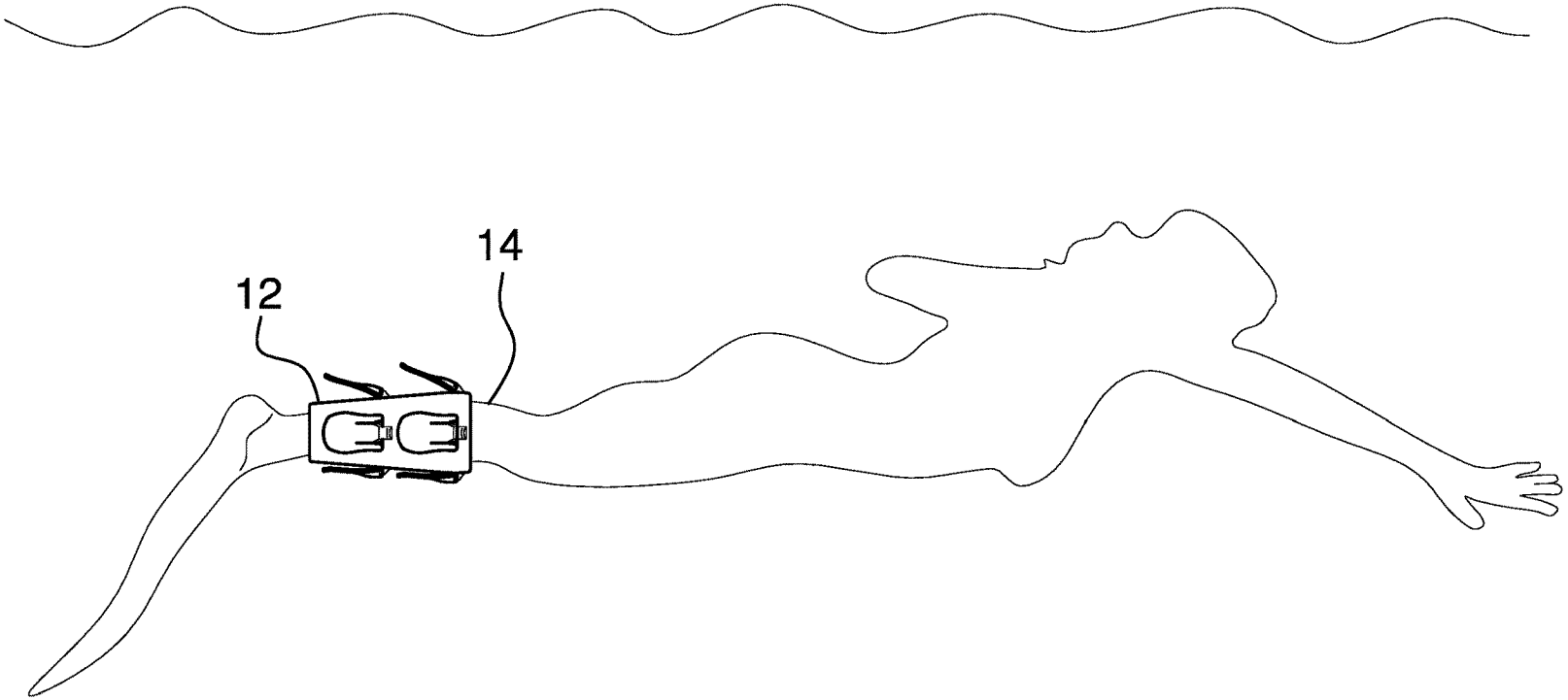
FIG. 5 is a perspective in-use view of an embodiment of the disclosure.

With reference now to the drawings, and in particular to FIGS. 1 through 5 thereof, a new fin device embodying the principles and concepts of an embodiment of the disclosure and generally designated by the reference numeral 10 will be described.

As best illustrated in FIGS. 1 through 5, the swim fin assembly 10 generally comprises a sleeve 12 that is worn around a lower leg 14 while swimming. The sleeve 12 has an inner surface 16, an outer surface 18 and a peripheral edge 20 extending therebetween, and the peripheral edge 20 has a first side 22 and a second side 24. The sleeve 12 is wrapped around the lower leg 14 having the inner surface 16 abutting the lower leg 14, having the outer surface 18 being exposed and having the first side 22 being spaced from the second side 24. A first mating member 25 is coupled to the sleeve 12 and the first mating member 25 is coextensive with the first side 22. A second mating member 26 is coupled to the sleeve 12 and the second mating member 26 is coextensive with the second side 24. The second mating member 26 releasably engages the first mating member 25 when the sleeve 12 is wrapped around the lower leg 14 such that the sleeve 12 forms a closed loop around the lower leg 14. Each of the first 24 and second 26 mating members may be complementary hook and loop fasteners or the like.

A plurality of fins 28 is each hingedly coupled to the sleeve 12. Each of the fins 28 is urged into a deployed position on a downstroke of the lower leg 14 during swimming. Thus, each of the fins 28 frictionally engages water thereby increasing thrust generated on the downstroke. Each of the fins 28 is urged into a stored position on an upstroke of the lower leg 14 during swimming. Thus, each of the fins 28 resists frictionally engaging the water thereby reducing drag on the upstroke.

A plurality of connection points 30 is each coupled to the outer surface 18 of the sleeve 12. The connection points 30 are spaced apart from each other and are distributed on the outer surface 18. Moreover, the connection points 30 may be arranged to form a pair of rows extending around the sleeve 12. Each of the fins 28 has a bottom surface 32, a top surface 34 and an outer edge 36, and the outer edge 36 of each of the fins 28 pivotally engages a respective one of the connection points 30. The bottom surface 32 of each of the fins 28 lies on the outer surface 18 of the sleeve 12 when the fins 28 are in the stored position. Alternatively, the bottom surface 32 of each of the fins 28 is spaced from the outer surface 18 of the sleeve 12 when the fins 28 are in the deployed position. The top surface 34 of each of the fins 28 has a stop 38 thereon, and the stop 38 on each of the fins 28 abuts the respective connection point 30 when the fins 28 are in the deployed position. In this way the fins 28 are retained at a pre-determined angle when the fins 28 are in the deployed position thereby facilitating the fins 28 to generate thrust.

In use, the sleeve 12 is wrapped around the lower leg 14 and the first mating member 25 is mated to the second mating member 26. The fins 28 are compressed against the sleeve 12 on the upstroke of the lower leg 14 during swimming. Thus, the fins 28 pose minimum resistance in the water during the upstroke. Each of the fins 28 frictionally engages the water and each of the fins 28 is urged into the deployed position on the downstroke of the lower leg 14 during swimming. Additionally, the stop 38 on each of the fins 28 abuts the respective connection point 30 thereby facilitating each of the fins 28 to generate thrust on the downstroke. In this way the fins 28 enhance the speed at which a user can propel themselves through the water during swimming.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A swim fin assembly comprising:

a sleeve adapted to be worn around a lower leg while swimming;

a plurality of fins, each of the fins being hingedly coupled to the sleeve, each of the fins being urged into a deployed position pivoting in a direction away from said sleeve when said sleeve is moved such that the fins are configured to have water urging said fin away from said sleeve, each of the fins being urged into a stored position pivoting back towards said sleeve when said sleeve is moved such that said fins are configured to have the water urging said fin towards said sleeve; and wherein said fins are arranged on said sleeve into three pairs, said pairs being positioned in alignment on respective sides of said sleeve such that each of said pairs of said fins is configured to be positioned along a shin, a calf, and an outside of the lower leg respectively.

2. The assembly according to claim 1, wherein:

the sleeve has an inner surface, an outer surface and a peripheral edge extending therebetween, the peripheral edge having a first side and a second side, the sleeve being adapted to be wrapped around the lower leg with the inner surface being adapted to abut abutting the lower leg, having the outer surface being exposed, and having the first side being spaced from the second side; and a plurality of connection points, each of the connection points being coupled to the outer surface of the sleeve, the connection points being spaced apart from each other and being distributed on the outer surface.

3. The assembly according to claim 2, further comprising:

a first mating member being coupled to the sleeve, the first mating member being coextensive with the first side; and a second mating member being coupled to the sleeve, the second mating member being coextensive with the second side, the second mating member releasably engaged to the first mating member wherein the sleeve is adapted to be wrapped around the lower leg such that the sleeve is adapted to form a closed loop around the lower leg.

4. The assembly according to claim 2, wherein each of the fins has a bottom surface and an outer edge, the outer edge of each of the fins pivotally engaging a respective one of the connection points, the bottom surface of each of the fins lying on the outer surface of the sleeve when the fins are in the stored position, the bottom surface of each of the fins being spaced from the outer surface of the sleeve when the fins are in the deployed position.

5. A swim fin assembly comprising:

a sleeve adapted to be worn around a lower leg while swimming, the sleeve having an inner surface, an outer surface and a peripheral edge extending therebetween, the peripheral edge having a first side and a second side, the sleeve being being adapted to be wrapped around the lower leg with the inner surface being adapted to abut the lower leg having the outer surface being exposed, and having the first side being spaced from the second side;

a first mating member being coupled to the sleeve, the first mating member being coextensive with the first side;

a second mating member being coupled to the sleeve, the second mating member being coextensive with the second side, the second mating member releasably engaged to the first mating member wherein the sleeve is adapted to be wrapped around the lower leg such that the sleeve is adapted to form a closed loop around the lower leg;

a plurality of connection points, each of the connection points being coupled to the outer surface of the sleeve, the connection points being spaced apart from each other and being distributed on the outer surface;

a plurality of fins, each of the fins being hingedly coupled to the sleeve, each of the fins being urged into a deployed position pivoting in a direction away from said sleeve when said sleeve is moved such that the fins are configured to have water urging said fin away from said sleeve, each of the fins being urged into a stored position pivoting back towards said sleeve when said sleeve is moved such that said fins are configured to have the water urging said fin towards said sleeve, each of the fins having a bottom surface and an outer edge, the outer edge of each of the fins pivotally engaging a respective one of the connection points, the bottom surface of each of the fins lying on the outer surface of the sleeve when the fins are in the stored position, the bottom surface of each of the fins being spaced from the outer surface of the sleeve when the fins are in the deployed position; and wherein said fins are arranged on said sleeve into three pairs, said pairs being positioned in alignment on respective sides of said sleeve such that each of said pairs of said fins is configured to be positioned along a shin, a calf, and an outside of the lower leg respectively.

* * * * *